US012723391B2

(12) United States Patent
Lin et al.

(10) Patent No.: US 12,723,391 B2
(45) Date of Patent: Sep. 1, 2026

(54) WASTE DISCHARGE PIPE, WASTE DISCHARGE SYSTEM, WASTE DISCHARGE CONTROL METHOD, WASTE DISCHARGE CONTROL APPARATUS, AND TOILET

(71) Applicant: QUANZHOU KOMOO INTELLIGENT KITCHEN & BATH CO., LTD, Quanzhou (CN)

(72) Inventors: Xiaofa Lin, Quanzhou (CN); Xiaoshan Lin, Quanzhou (CN); Shan Lin, Quanzhou (CN); Rongrong Xu, Quanzhou (CN); Zhida Chen, Quanzhou (CN)

(73) Assignee: QUANZHOU KOMOO INTELLIGENT KITCHEN & BATH CO., LTD, Quanzhou (CN)

( * ) Notice: Subject to any disclaimer, the term of this patent is extended or adjusted under 35 U.S.C. 154(b) by 183 days.

(21) Appl. No.: 18/840,825

(22) PCT Filed: Dec. 19, 2022

(86) PCT No.: PCT/CN2022/140117

§ 371 (c)(1),
(2) Date: Aug. 22, 2024

(87) PCT Pub. No.: WO2024/031910

PCT Pub. Date: Feb. 15, 2024

(65) Prior Publication Data

US 2025/0188725 A1 Jun. 12, 2025

(30) Foreign Application Priority Data

Aug. 12, 2022 (CN) ..... 202210968929.8
Aug. 12, 2022 (CN) ..... 202210971678.9

(51) Int. Cl.
*E03D 11/10* (2006.01)

(52) U.S. Cl.
CPC ..... *E03D 11/10* (2013.01)

(58) Field of Classification Search
CPC ..... E03D 11/10; E03D 11/13; E03D 11/16; E03D 11/18

(Continued)

(56) References Cited

U.S. PATENT DOCUMENTS

2013/0227773 A1* 9/2013 Park ..... E03D 11/18 4/420
2025/0101727 A1* 3/2025 Lin ..... E03D 11/10

FOREIGN PATENT DOCUMENTS

CN 102587473 B 5/2014
CN 105951965 A 9/2016

(Continued)

OTHER PUBLICATIONS

International Search Report for International Application No. PCT/CN2022/140117, dated Feb. 13, 2023, 6 pages.

(Continued)

*Primary Examiner* — Tuan N Nguyen
(74) *Attorney, Agent, or Firm* — BROOKS KUSHMAN P.C.

(57) ABSTRACT

A waste discharge pipe having: a pipe main body, provided with a waste inlet, a waste discharge port, and an overflow port, wherein the waste discharge port and the waste inlet face different directions; the waste inlet is configured to be communicated with a waste outlet of a toilet seat body; the pipe main body is configured to be capable of rotating, between an initial position and a waste discharge position, relative to the toilet seat body around the central axis of the waste inlet; and when the pipe main body is located at the initial position, the opening of the waste discharge port face (Continued)

upwards, and the overflow port is located at the lower side of the waste discharge port and located at the upper side of the waste inlet.

20 Claims, 8 Drawing Sheets

(58) Field of Classification Search
USPC ..... 4/300, 420, 421, 424, 427, 428
See application file for complete search history.

(56) References Cited

FOREIGN PATENT DOCUMENTS

| | | | |
|---|---|---|---|
| CN | 205822402 | U | 12/2016 |
| CN | 206337621 | U | 7/2017 |
| CN | 206448336 | U | 8/2017 |
| CN | 107859131 | A | 3/2018 |
| CN | 109235577 | A | 1/2019 |
| CN | 208701836 | U | 4/2019 |
| CN | 209397675 | U | 9/2019 |
| CN | 211596970 | U | 9/2020 |
| CN | 212772682 | U | 3/2021 |
| CN | 114411907 | A | 4/2022 |
| CN | 114411908 | A | 4/2022 |
| CN | 114411909 | A | 4/2022 |
| CN | 114411910 | A | 4/2022 |
| CN | 114457888 | A | 5/2022 |
| CN | 114482219 | A | 5/2022 |
| CN | 216948602 | U | 7/2022 |
| CN | 115306008 | A | 11/2022 |
| CN | 115404963 | A | 11/2022 |
| JP | H06306921 | A | 11/1994 |
| JP | 2009203644 | A | 9/2009 |
| JP | 2010013801 | A | 1/2010 |
| JP | 2010150920 | A | 7/2010 |
| JP | 2013079565 | A | 5/2013 |
| JP | 2016108784 | A | 6/2016 |
| JP | 2020051227 | A | 4/2020 |
| JP | 2022013353 | A | 1/2022 |

OTHER PUBLICATIONS

KIPO Office Action in KR Application No. 10-2024-7040561 dated Oct. 28, 2025, 11 pages (including English translation).
CNIPA Second Office Action CN Application No. 202210968929.8 dated Sep. 10, 2025, 14 pages (including English Translation).
CNIPA Decision of Rejection in CN Application No. 202210968929.8 dated Nov. 19, 2025, 14 pages (including English Translation).
CNIPA Second Office Action CN Application No. 202210971678.9 dated Sep. 10, 2025, 13 pages (including English Translation).
CNIPA Decision of Rejection in CN Application No. 202210971678.9 dated Nov. 19, 2025, 16 pages (including English Translation).
European Search Report for EP Application No. 22954848.2-1005 / 4467735 PCT/CN2022140117, dated May 6, 2025, 9 pages.
CNIPA First Office Action in CN Application No. 2022109689298 dated Apr. 26, 2025 (17 pages, including English translation).
CNIPA First Office Action in CN Application No. 2022109716789 dated Apr. 26, 2025 (17 pages, including English translation).
JPO Office Action in JP Application No. 2024-572144 dated Dec. 9, 2025, 10 pages (including English translation).

* cited by examiner

WASTE DISCHARGE PIPE, WASTE DISCHARGE SYSTEM, WASTE DISCHARGE CONTROL METHOD, WASTE DISCHARGE CONTROL APPARATUS, AND TOILET

CROSS-REFERENCE TO RELATED APPLICATIONS

The present application is the U.S. National Phase of PCT Application No. PCT/CN2022/140117, filed on Dec. 19, 2022, which claims priority to Chinese Patent Application No. 202210971678.9, filed on Aug. 12, 2022, and Chinse Patent Application No. 202210968929.8, filed on Aug. 12, 2022, the disclosures of which are hereby incorporated herein by reference in their entireties.

TECHNICAL FIELD

The present disclosure relates to, but is not limited to, the field of kitchen and washroom technologies, and particularly relates to a sewage discharge pipe, a sewage discharge system, a sewage discharge control method, a sewage discharge control apparatus, and a toilet.

BACKGROUND

At present, a sewage discharge mode for a sewage discharge pipe applied in a rear-mounted sewage discharge system of a toilet usually adopts a mode that discharges as much water as stored in an initial state, so that an amount of water storage in the initial state of the toilet has a great impact on a sewage discharge and flushing effect. In order to improve the sewage discharge and flushing effect, it is necessary to increase the amount of water storage in the initial state, and it is necessary to make the sewage discharge pipe to be higher, so that a water seal of the toilet is higher. However, although the amount of water storage is increased in this way, a higher water seal surface makes a user prone to water splashing when the user uses the toilet, which affects the user experience.

SUMMARY

The following is a summary of the subject matter described in detail herein. This summary is not intended to limit the protection scope of the claims.

An embodiment of the present disclosure provides a sewage discharge pipe, including: a pipe main body. The pipe main body is provided with a sewage inlet port, a sewage discharge port, and an overflow port, the sewage discharge port is in a different direction from the sewage inlet port, the sewage inlet port is configured to be communicated with a sewage outlet of a toilet seat body, and the pipe main body is configured to be capable of rotating between an initial position and a sewage discharge position around a central axis of the sewage inlet port relative to the toilet seat body. In a state where the pipe main body is located at the initial position, an opening of the sewage discharge port faces upwards, and the overflow port is located on a lower side of the sewage discharge port and on an upper side of the sewage inlet port.

An embodiment of the present disclosure also provides a sewage discharge system, including: a sewage discharge box; the sewage discharge pipe according to any one of aforementioned embodiments at least partially located in the sewage discharge box and rotatably connected to the sewage discharge box; and a drive apparatus. The drive apparatus is connected to the sewage discharge pipe, and is configured to drive the sewage discharge pipe to rotate relative to the sewage discharge box.

An embodiment of the present disclosure also provides a toilet, including: a toilet seat body provided with a basin cavity, the basin cavity being provided with a sewage outlet; and the sewage discharge system according to an aforementioned embodiment, the sewage discharge system being installed on the toilet seat body, and the sewage inlet port of the sewage discharge system being in communication with the sewage outlet.

An embodiment of the present disclosure provides a sewage discharge control method, which is applied to a toilet. The toilet includes a toilet seat body, a brush ring flushing apparatus, and a sewage discharge pipe. The sewage discharge pipe is provided with a sewage inlet port, a sewage discharge port, and an overflow port. The sewage inlet port communicates with a sewage outlet of the toilet seat body, and the sewage discharge pipe is configured to be capable of rotating between an initial position and a sewage discharge position relative to the toilet seat body. When the sewage discharge pipe is at the initial position, the overflow port is located on a lower side of the sewage discharge port and on an upper side of the sewage inlet port, and a water seal surface of the toilet is flush with a lowest point of the overflow port. The sewage discharge control method includes: controlling the brush ring flushing apparatus to flush water to a pot surface of the toilet seat body to increase a height of water seal of the toilet based on the sewage discharge pipe being at the initial position; and controlling the sewage discharge pipe to rotate downwards from the initial position to the sewage discharge position to discharge sewage.

An embodiment of the present disclosure also provides a sewage discharge control apparatus, including a processor and a memory storing a computer program. The processor implements the steps of the sewage discharge control method according to any one of aforementioned embodiments when executing the computer program.

An embodiment of the present disclosure also provides a toilet, including the sewage discharge control apparatus according to an aforementioned embodiment.

Other aspects will become apparent after reading and understanding the drawings and detailed description.

BRIEF DESCRIPTION OF THE DRAWINGS

The drawings are used to provide understanding of the technical solutions of the present disclosure, constitute a part of the specification, and together with the embodiments of the present disclosure, are used to explain the technical solutions of the present disclosure but not to form limitations on the technical solutions of the present disclosure.

REFERENCE SIGNS ARE DESCRIBED AS FOLLOWS

Figure 1:
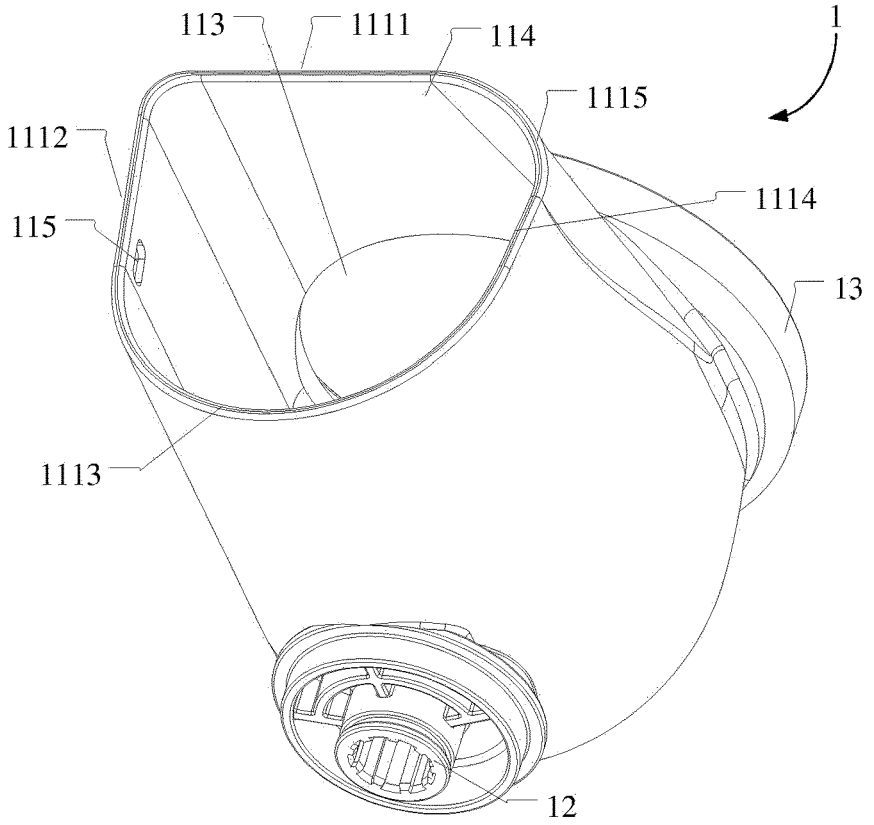
FIG. 1 is a schematic diagram of a three-dimensional structure of a sewage discharge pipe according to one embodiment of the present disclosure.

1 sewage discharge pipe, 11 pipe main body, 111 cylindrical part, 1111 first plate part, 1112 second plate part, 1113 third plate part, 1114 fourth plate part, 1115 curved plate, 112 bottom sealing part, 113 sewage inlet port, 114 sewage discharge port, 115 overflow port, 12 rotation connection part, 13 connection boss;

2 sewage discharge box, 21 box main body, 211 dirt inlet, 22 box cover, 221 connection hole, 24 dirt outlet, 25 sealing ring, 26 first sealing element, 27 second sealing element;

3 drive apparatus;

4 toilet seat body, 41 basin cavity, 411 sewage outlet, 42 brush ring flushing apparatus, 43 flow detection apparatus;

5 shifter;

502 memory, 504 processor.

DETAILED DESCRIPTION

The present disclosure describes multiple embodiments, but this description is exemplary and not limiting, and it will be obvious to those of ordinary skills in the art that more embodiments and implementations may be included within the scope of the embodiments described by the present disclosure. Although many possible combinations of features are shown in the drawings and discussed in the implementations, many other combinations of the disclosed features are also possible. Unless specifically limited, any feature or element of any embodiment may be used in combination with, or may substitute for, any other feature or element of any other embodiment.

The present disclosure includes and contemplates combinations with features and elements known to those of ordinary skills in the art. The embodiments, features and elements already disclosed in the present disclosure may also be combined with any conventional features or elements to form the unique technical solutions defined by the claims. Any feature or element of any embodiment may also be combined with features or elements from other technical solutions to form another unique technical solution defined by the claims. Accordingly, it should be understood that any of the features shown and/or discussed in the present disclosure may be implemented alone or in any suitable combination. Thus, the embodiments are not subjected to limitations other than those made in accordance with the appended claims and their equivalent substitutions. In addition, various modifications and changes may be made within the protection scope of the appended claims.

Furthermore, when describing representative embodiments, the specification may have presented a method and/or process as a particular sequence of steps. However, to the extent that the method or process does not depend on the specific order of steps described herein, the method or process should not be limited to the specific order of steps described. As will be understood by those of ordinary skill in the art, other order of steps is also possible. Accordingly, a particular order of steps set forth in the specification should not be construed as limitations on the claims. Furthermore, the claims for the method and/or process should not be limited to the steps which are performed in the written order. Those skilled in the art can readily understand that these orders can be changed and the changed orders still remain within the spirit and scope of the embodiments of the present disclosure.

As shown in FIGS. 1 to 4, an embodiment of the present disclosure provides a sewage discharge pipe 1 including a pipe main body 11. The pipe main body 11 is provided with a sewage inlet port 113, a sewage discharge port 114, and an overflow port 115. The sewage discharge port 114 is in a different direction from the sewage inlet port 113. The sewage inlet port 113 is configured to be communicated with a sewage outlet 411 of a toilet seat body 4. The pipe main body 11 is configured to be capable of rotating between an initial position and a sewage discharge position around a central axis of the sewage inlet port 113 relative to the toilet seat body 4.

Figure 2:
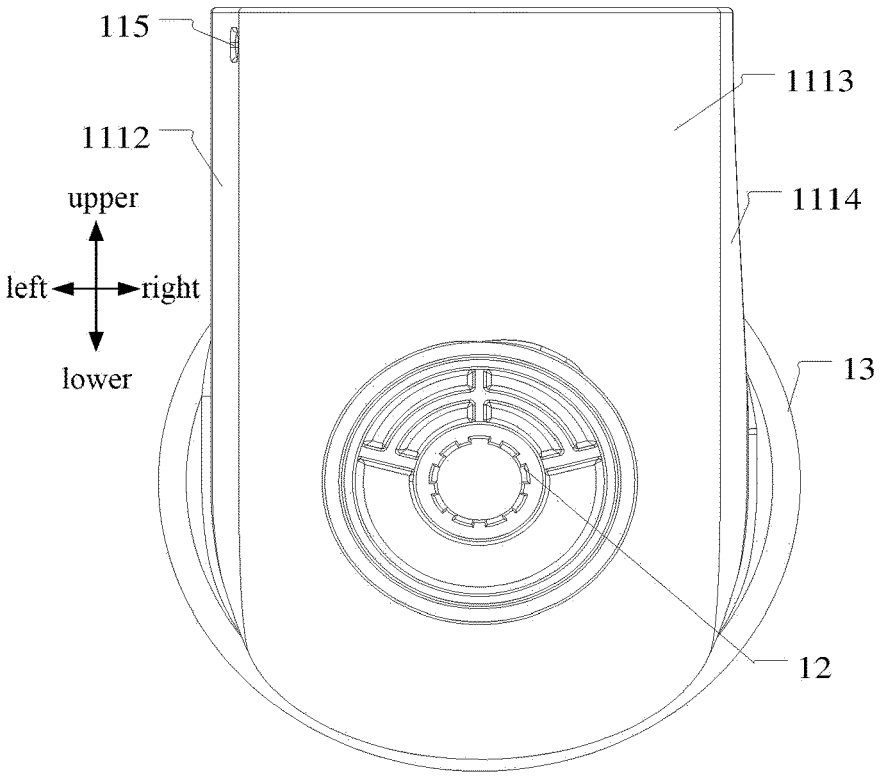
FIG. 2 is a rear schematic view of a structure of the sewage discharge pipe shown in FIG. 1.
Figure 3:
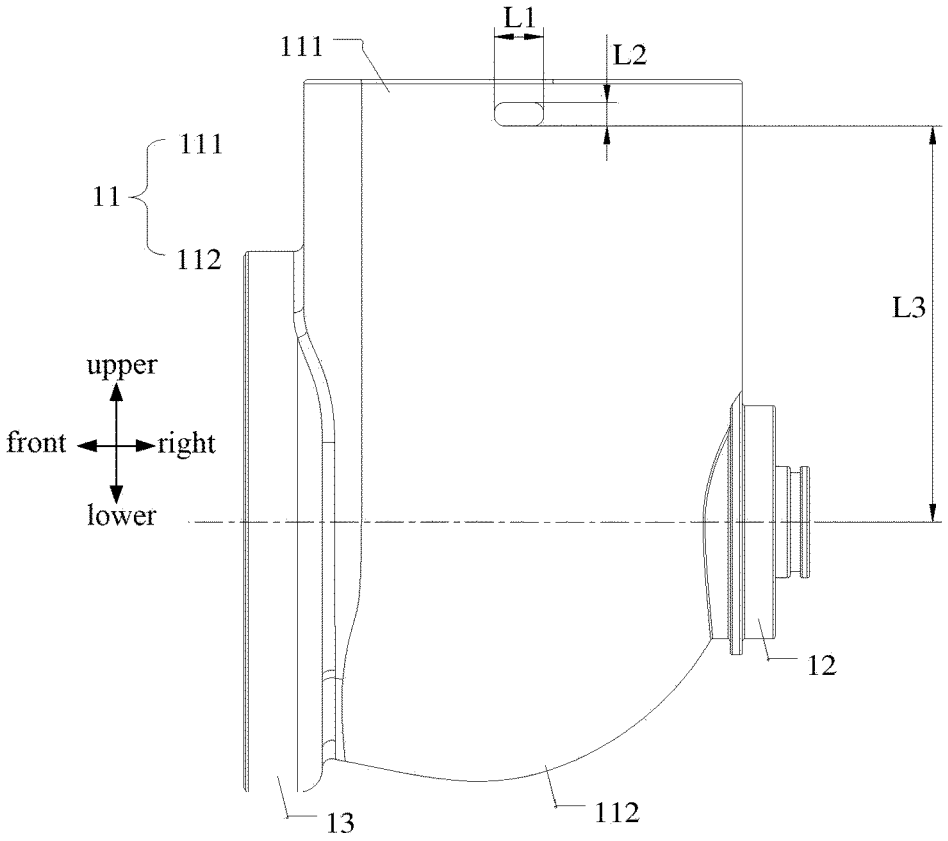
FIG. 3 is a right schematic view of a structure of the sewage discharge pipe shown in FIG. 1.

As shown in FIGS. 2 and 3, in a state where the pipe main body 11 is at the initial position, an opening of the sewage discharge port 114 faces upwards, and the overflow port 115 is located on a lower side of the sewage discharge port 114 and on an upper side of the sewage inlet port 113.

The sewage discharge pipe 1 provided by an embodiment of the present disclosure includes the pipe main body 11 provided with the sewage inlet port 113, the sewage discharge port 114, and the overflow port 115. Since the sewage inlet port 113 of the pipe main body 11 can communicate with the sewage outlet 411 of the toilet seat body 4, sewage in the toilet seat body 4 can enter the sewage discharge pipe 1 through the sewage inlet port 113. Since the sewage outlet 411 of the toilet seat body 4 is generally provided towards the rear, the sewage inlet port 113 of the pipe main body 11 is provided towards the front accordingly after the toilet is assembled, and may be provided towards the front straightly, or may be provided towards the front with an appropriate inclination. Since the pipe main body 11 can rotate between the initial position and the sewage discharge position around the central axis of the sewage inlet port 113 relative to the toilet seat body 4, sewage can be discharged from the sewage discharge port 114 under an action of the gravitational potential energy and the falling discharge inertia, and an overturn sewage discharge function is realized.

Figure 9:
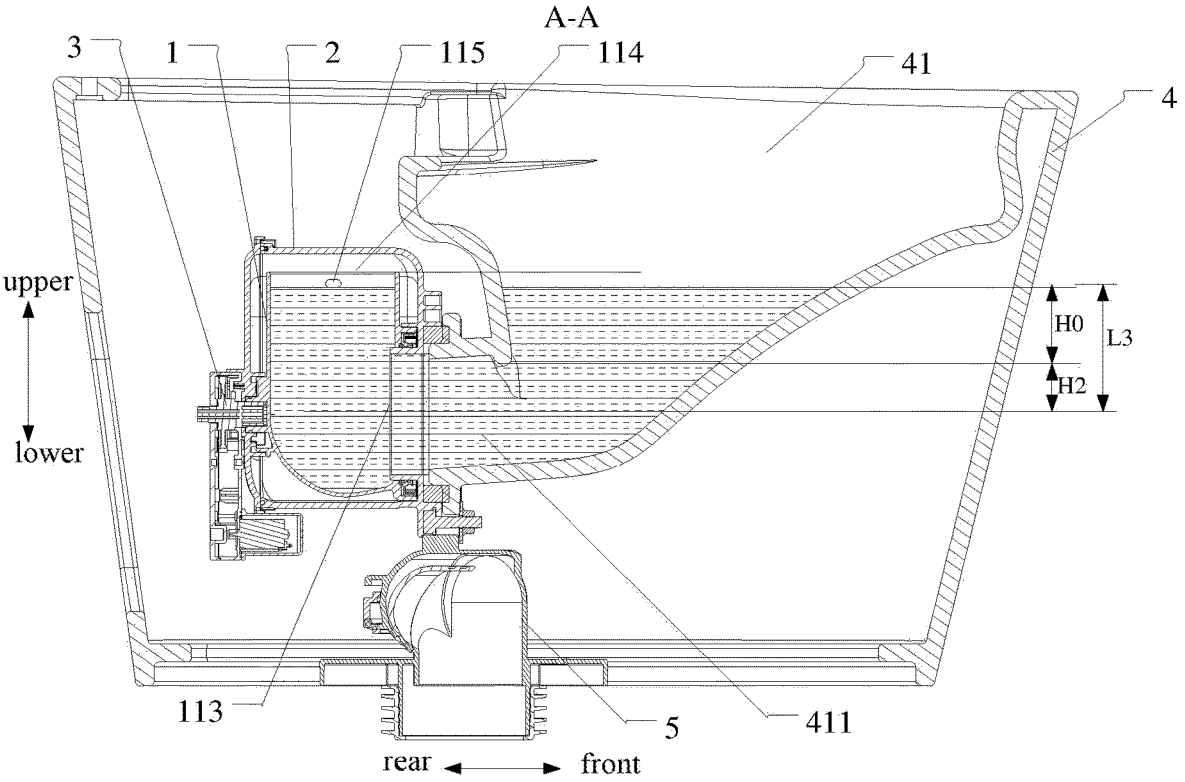
FIG. 9 is schematic sectional diagram of a structure of the toilet in a first state along an A-A direction shown in FIG. 8.
Figure 10:
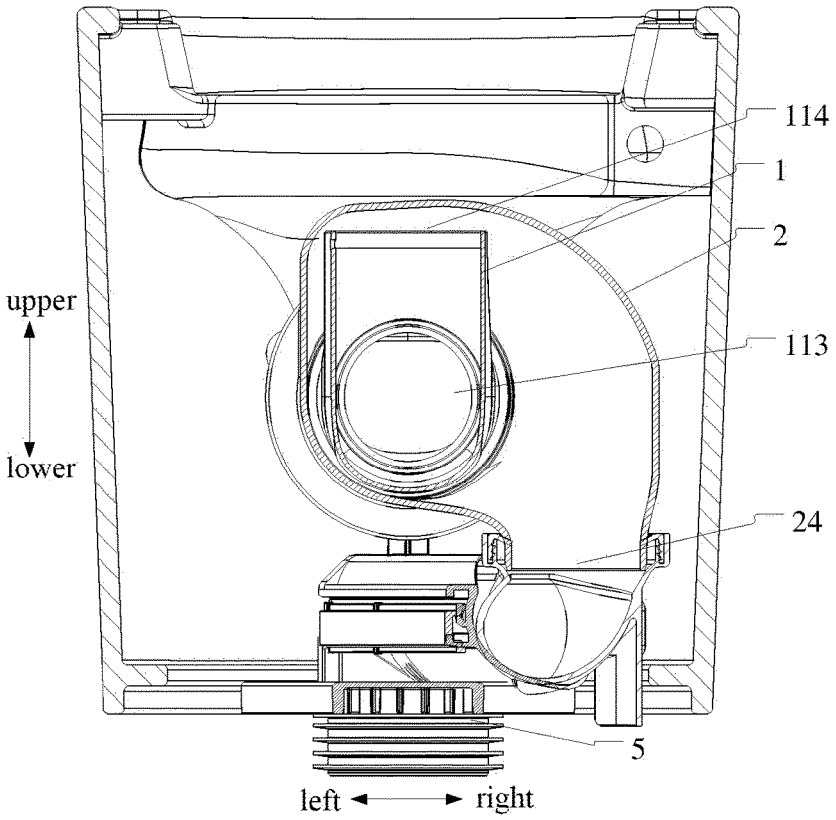
FIG. 10 is a schematic sectional diagram of a structure of the toilet in another visual angle as shown in FIG. 9.

As shown in FIGS. 9 and 10, in a state where the pipe main body 11 is at the initial position, the opening of the sewage discharge port 114 faces upwards, and the overflow port 115 is located on the upper side of the sewage inlet port 113, so that it is ensured that a water seal can be formed in the toilet. Since the overflow port 115 is located on the lower side of the sewage discharge port 114 at this time, the liquid in the sewage discharge pipe 1 above the overflow port 115 flows out through the overflow port 115 until a water seal surface is flush with a lowest point of the overflow port 115. Therefore, the overflow port 115 can reduce a height of a position of the water seal surface and prevent water splashing when the user uses the toilet, which is beneficial to improving the user experience.

Figure 11:
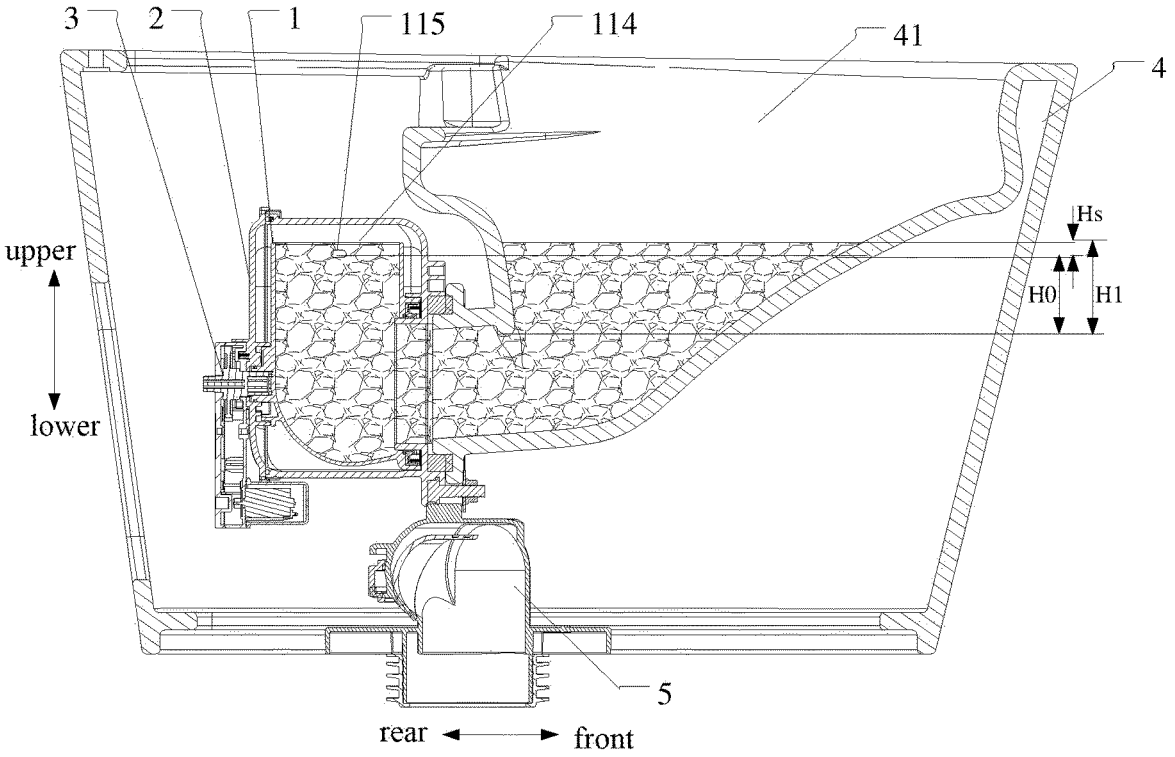
FIG. 11 is schematic sectional diagram of a structure of the toilet in a second state along an A-A direction shown in FIG. 8.
Figure 12:
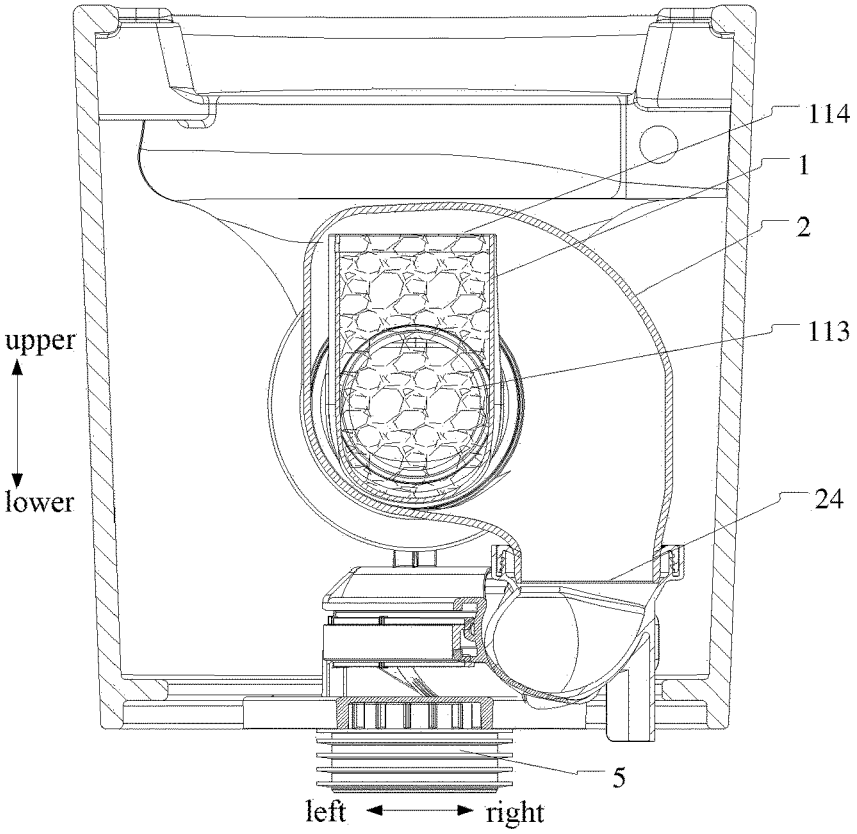
FIG. 12 is a schematic sectional diagram of a structure of the toilet in another visual angle as shown in FIG. 11.
Figure 13:
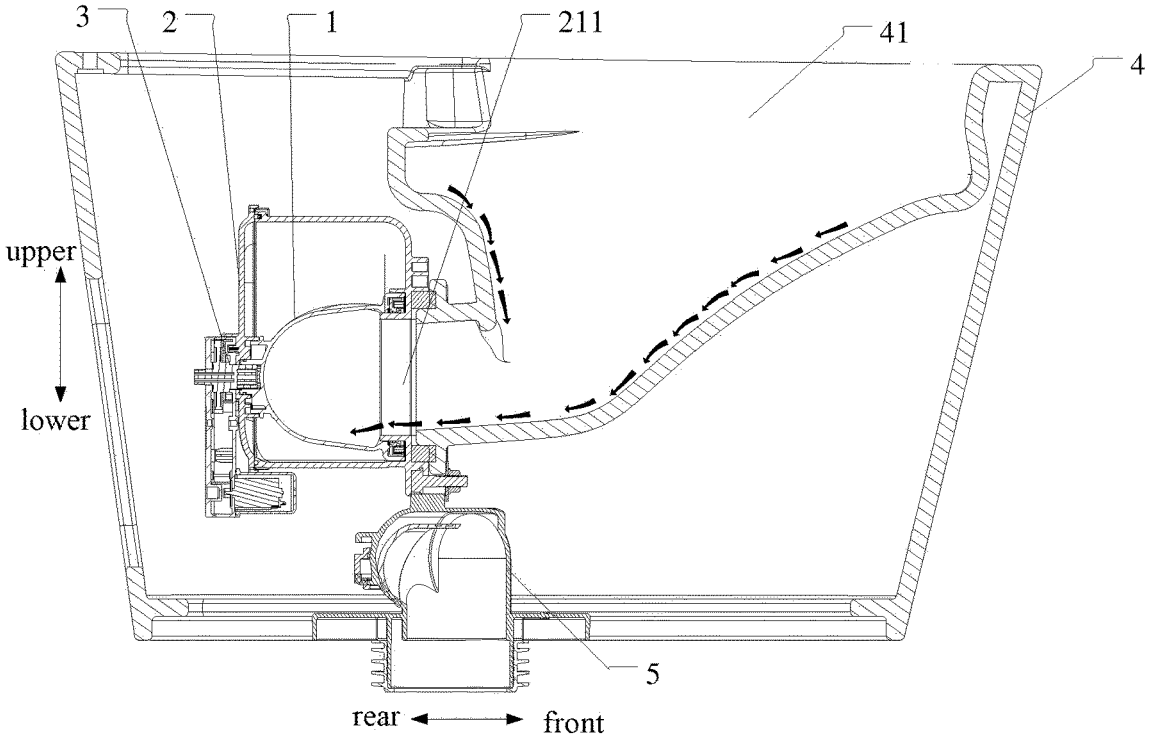
FIG. 13 is schematic sectional diagram of a structure of the toilet in a third state along an A-A direction shown in FIG. 8.
Figure 14:
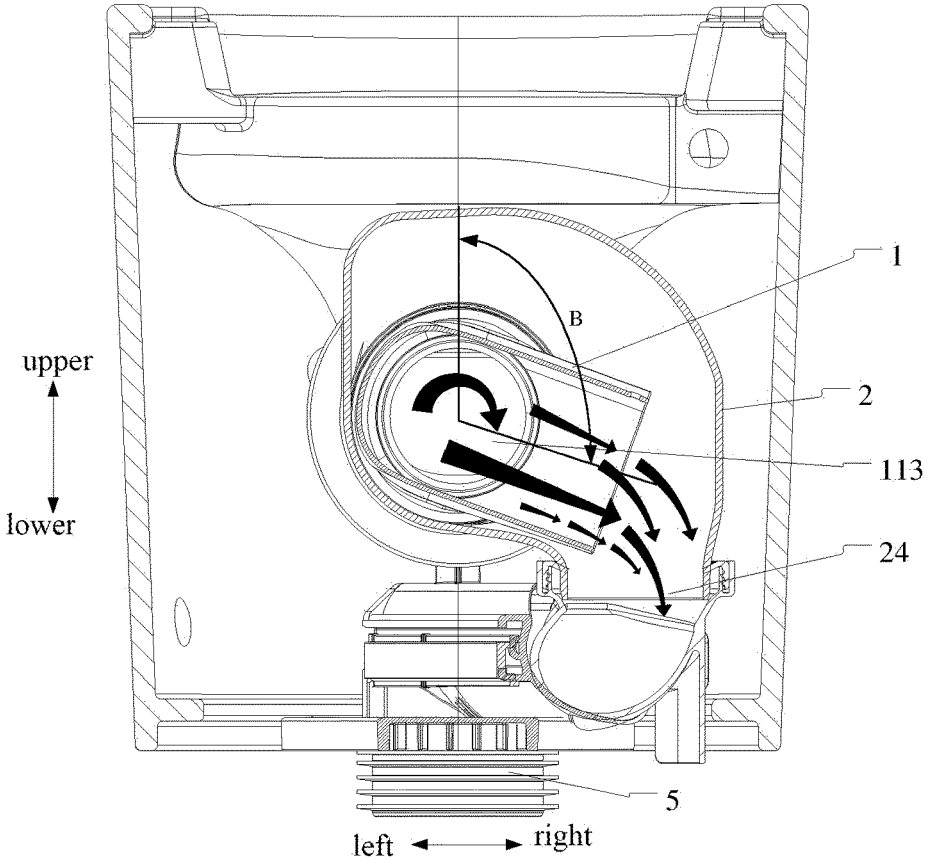
FIG. 14 is a schematic sectional diagram of a structure of the toilet in another visual angle as shown in FIG. 13.

When it is necessary to discharge sewage, water begins to enter an inside of the toilet seat body 4. Since a flow rate of water inflow is much greater than a flow rate of overflow of the overflow port 115, the water seal surface in the toilet can be rapidly raised to a position where the sewage discharge port 114 is located, as shown in FIGS. 11 and 12, thereby increasing a volume of flushing water and gravitational potential energy of the flushing water. Then the sewage discharge pipe 1 is rotated downwards to the sewage discharge position (as shown in FIGS. 13 and 14), and a relatively large water volume and gravitational potential energy can be used to achieve a better sewage discharge and flushing effect.

Therefore, by adding the overflow port 115 to the sewage discharge pipe 1 in the present solution, a height of the water seal surface of the toilet can be controlled through the overflow port 115, so that the water seal surface of the toilet is at a relatively low position in a non-sewage discharge state (as shown in FIGS. 9 and 10), thereby preventing a height of the water seal surface of the toilet from being too high and causing water splashing when the user uses the toilet. A flow rate of overflow of the overflow port 115 is much less than a flow rate of water inflow of the toilet seat body 4, so that the water seal surface of the toilet can be raised to a relatively high position during sewage discharge (as shown in FIGS. 11 and 12), thereby increasing the gravitational potential energy of the flushing water and improving the sewage discharge and flushing effect of the toilet.

Moreover, compared with a solution that changes a height of the water seal by controlling a position change of the sewage discharge pipe 1 (i.e., in a standby state, the sewage discharge pipe 1 is at an inclined position to lower the water seal surface, and when it is necessary to discharge sewage, first the sewage discharge pipe 1 is controlled to rotate to an upright position to raise the water seal surface, and then the sewage discharge pipe 1 is controlled to rotate downwards to discharge sewage), the present solution can achieve an effect of changing a height of water seal by a simple improvement of a structure of the sewage discharge pipe 1. A position of the sewage discharge pipe 1 only needs to be changed between the initial position and the sewage discharge position, and switching to the inclined position in the standby state is eliminated. Therefore, an electronic control program of the sewage discharge pipe 1 can be simplified, and a failure rate of the electronic control can be reduced.

In an exemplary embodiment, as shown in FIGS. 1 to 4, the sewage discharge pipe 1 further includes a rotation connection part 12 connected to the pipe main body 11 and configured to connect a drive apparatus 3 for driving the pipe main body 11 to rotate around a central axis of the sewage inlet port 113.

In this way, after the assembly is completed, the drive apparatus 3 drives the rotation connection part 12 to rotate, thereby driving the whole sewage discharge pipe 1 to rotate around the central axis of the sewage inlet port 113 relative to the toilet seat body 4.

The drive apparatus 3 may be a motor, a gearbox or the like. A shape of the rotation connection part 12 is not limited. For example, it may be a non-circular annular boss for connection to a motor shaft, or it may be internally provided with a gear-shaped protrusion to facilitate connection to a gear shaft.

In an exemplary embodiment, as shown in FIGS. 1 to 4, the sewage discharge pipe 1 further includes a connection boss 13 located outside the sewage inlet port 113 and connected to an outer wall of the pipe main body 11, and an inner diameter of the connection boss 13 is greater than a diameter of the sewage inlet port 113.

An arrangement of the connection boss 13 facilitates a rotational connection between the sewage discharge pipe 1 and a sewage discharge box 2 or other structures, and also facilitates the installation of a sealing element, so as to realize a sealing cooperation between the sewage discharge pipe 1, the sewage discharge box 2 and a basin cavity 41 of the toilet, and prevent a leakage of sewage.

In an exemplary embodiment, as shown in FIG. 3, one end of the pipe main body 11 forms a sewage discharge port 114, the other end of the pipe main body 11 is provided as closed, and the sewage inlet port 113 is provided in a side wall of the pipe main body 11.

Compared with a conventional L-shaped elbow pipe, the present solution is beneficial to reducing a lateral length of the sewage discharge pipe 1, which is beneficial to shortening a flow path of the sewage, and is further beneficial to improving the sewage discharge performance of the toilet. On the other hand, this can further reduce a demand for installation space of the sewage discharge pipe 1, thereby helping to reduce a volume of the toilet.

In an exemplary embodiment, the pipe main body 11 includes a cylindrical part 111 and a bottom sealing part 112, as shown in FIG. 3.

One end of the cylindrical part 111 forms a sewage discharge port 114. A sewage inlet port 113 is provided in a side wall of the cylindrical part 111 and extends to the other end of the cylindrical part 111. The bottom sealing part 112 is connected to the other end of the cylindrical part 111, and seals and covers the other end of the cylindrical part 111.

In the present solution, the pipe main body 11 includes the cylindrical part 111 and the bottom sealing part 112. One end of the cylindrical part 111 forms the sewage discharge port 114, and the other end of the cylindrical part 111 is sealed and covered by the bottom sealing part 112, and the sewage discharge port 114 is provided on a side wall of the cylindrical part 111 and extends to an end of the cylindrical part 111 close to the bottom sealing part 112. Therefore, during sewage discharge, the sewage entering the pipe main body 11 from the sewage discharge port 114 can only flow substantially in a direction where the sewage discharge port 114 is located, which is beneficial to realizing a directional flow of sewage in the sewage discharge pipe 1, avoiding an accumulation of sewage residue at a bottom of the pipe main body 11, and thus improving the sewage discharge performance of the toilet.

In an exemplary embodiment, the bottom sealing part 112 is recessed in a direction away from the sewage discharge port 114, as shown in FIG. 3, so that a maximum distance between the bottom sealing part 112 and the sewage discharge port 114 is greater than a maximum distance between the sewage inlet port 113 and the sewage discharge port 114.

In this way, a position of a lowest point of the pipe main body 11 at the initial position can be further lowered, which is beneficial to further increasing an amount of water storage in the toilet at the initial position, and is beneficial to further improving the sewage discharge and flushing performance of the toilet.

Figure 4:
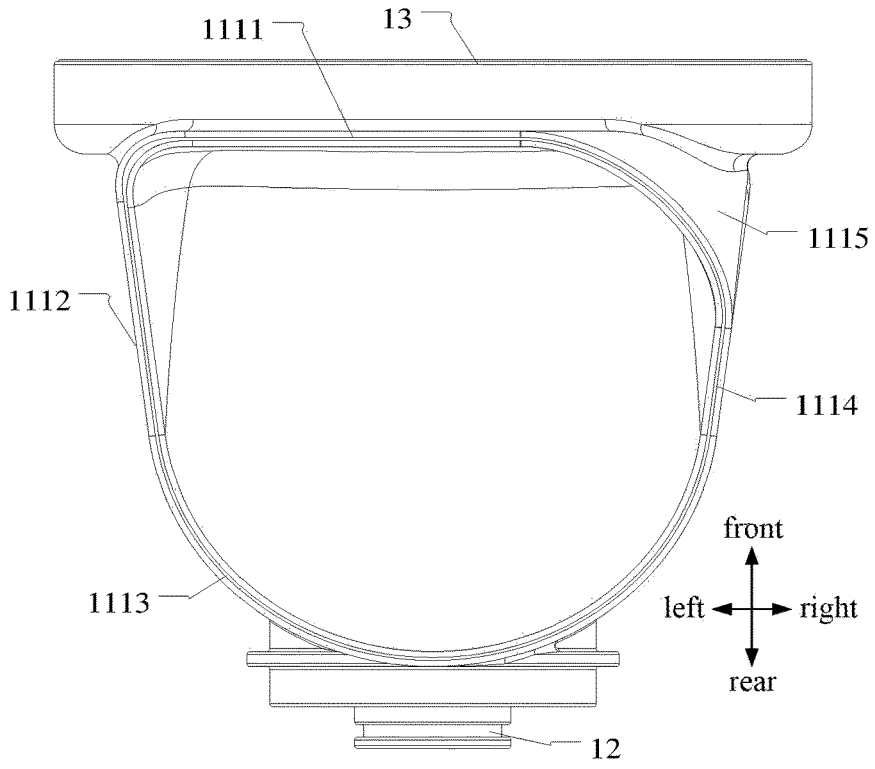
FIG. 4 is a top schematic view of a structure of the sewage discharge pipe shown in FIG. 1.

In an exemplary embodiment, the cylindrical part 111 includes a first plate part 1111, a second plate part 1112, a third plate part 1113, and a fourth plate part 1114 connected sequentially end to end in a circumferential direction of the cylindrical part 111, as shown in FIGS. 1, 2, and 4.

The first plate part 1111 is a first straight plate, and the sewage inlet port 113 is provided in the first plate part 1111.

This facilitates the processing and molding of the sewage inlet port 113 and further facilitates the processing of other structures at the sewage inlet port 113, so as to realize a rotatable connection between the sewage discharge pipe 1 and the sewage discharge box 2, thereby helping to reduce a difficulty of installation of the sewage discharge pipe 1.

The aforementioned rotation connection part 12 is provided at the third plate part 1113 and the connection boss 13 is provided at the first plate part 1111.

In an exemplary embodiment, the sewage discharge pipe 1 rotates to a side where the fourth plate part 1114 is located during a process of rotating from the initial position to the sewage discharge position. The second plate part 1112 is a second straight plate. The third plate part 1113 is an arc-shaped plate, and the arc-shaped plate is bent in a direction away from the first plate part 1111, as shown in FIGS. 1, 2, and 4.

As shown in FIGS. 1 and 4, the fourth plate part 1114 includes a third straight plate connected to the third plate part 1113, and a curved plate 1115 connected to the first plate part 1111. In a direction close to the sewage discharge port 114, the curved plate 1115 is curved and recessed in a direction close to the second plate part 1112 and the third plate part 1113.

In a conventional design, the cylindrical part 111 is designed as a circular pipe structure, and a radius of the circular pipe is equal to a radius of the third plate part 1113. In the present solution, the cylindrical part 111 is provided as an irregular special-shaped structure, which is equivalent to extending outwards a half cylinder of the conventional circular pipe structure close to the toilet seat body 4 to form a nearly prismatic structure (including three straight plates), so that the flow area of the cylindrical part 111 is increased, facilitating the improvement of the sewage discharge performance of the sewage discharge pipe 1. The curved plate 1115 of the fourth plate part 1114 is retracted inwards to facilitate the collection and discharge of sewage, and to prevent sewage from accumulating and remaining at corners of the first plate part 1111 and the fourth plate part 1114, thereby facilitating the improvement of the sewage discharge performance of the sewage discharge pipe 1.

In an exemplary embodiment, the overflow port 115 is provided in the second plate part 1112, as shown in FIGS. 1 and 2.

In this way, in the process of rotating the sewage discharge pipe 1 from the initial position to the sewage discharge position, the sewage will flow in a direction away from the overflow port 115, and it is possible to prevent the sewage from accumulating at the overflow port 115 during the sewage discharge process.

In addition, since the first plate part 1111 is to be rotatably connected to the sewage discharge box 2, and the third plate part 1113 is to be connected to the drive apparatus 3, providing the overflow port 115 in the second plate part 1112 further facilitates the smooth fall of the overflow water to avoid being blocked by the connection structure, preventing the drive apparatus 3 from contacting water, and preventing the overflow port 115 from being closed by sewage during the sewage discharge process.

In an exemplary embodiment, in a direction from the first plate part 1111 to the third plate part 1113, the second straight plate and the third straight plate extend obliquely in directions approaching each other, as shown in FIGS. 1 and 4.

Compared with a solution in which the second straight plate and the third straight plate are parallel to each other, the present solution further increases the flow area of the cylindrical part 111, and is beneficial to further improving the sewage discharge performance of the sewage discharge pipe 1.

In addition, this arrangement is further beneficial to increasing a width of the first straight plate, thereby increasing an area of the sewage inlet port 113, and further improving the sewage discharge performance of the sewage discharge pipe 1.

In an exemplary embodiment, the first plate part 1111, the second plate part 1112, the third plate part 1113, and the fourth plate part 1114 are smoothly connected, as shown in FIGS. 1 and 4. This can avoid the sewage from accumulation and being left over due to edges and corners in the sewage discharge pipe 1.

In an exemplary embodiment, a diameter of the sewage inlet port 113 is greater than a half of a length of the cylindrical part 111, as shown in FIG. 10. In this way, an area of the sewage inlet port 113 is relatively large, which is beneficial to further improving the sewage discharge performance.

In an exemplary embodiment, as shown in FIG. 3, in a state where the sewage discharge pipe 1 is at the initial position, a width L1 of the overflow port 115 is in a range from 5 mm to 30 mm, and a height L2 of the overflow port 115 is in a range from 2 mm to 10 mm.

The height and the width of the overflow port 115 affect the overflow rate of the overflow port 115, the rising rate of the water seal surface, the strength of the sewage discharge pipe 1, and the like. If the height and the width of the overflow port 115 are too large, the overflow rate will be too large, the water consumption required for the water seal of the toilet to rise to the sewage discharge port 114 will be increased, and a rising rate of the water seal surface is relatively small, and the strength of the sewage discharge pipe 1 will further be affected.

After research, the height of the overflow port 115 is limited to a range from 2 mm to 10 mm, such as 2 mm, 4 mm, 6 mm, 8 mm, 10 mm, and the width of the overflow port 115 is limited to a range of 5 mm to 30 mm, such as 5 mm, 10 mm, 15 mm, 20 mm, 25 mm, 30 mm. In this way, the overflow rate of the overflow port 115, the rising rate of the water seal surface, and the strength of the sewage discharge pipe 1 could all be taken into account.

Alternatively, the height of the overflow port 115 is not limited to the above range, and the width of the overflow port 115 is not limited to the above range. They could be adjusted as necessary.

In an exemplary embodiment, as shown in FIG. 3, a minimum distance L3 between the overflow port 115 and a central axis of the sewage inlet port 113 is in the range from 70 mm to 116 mm.

When the sewage discharge pipe 1 is at the initial position, a position of a lowest point of the overflow port 115 determines an upper limit of the water seal surface in the toilet. A position of a lowest point of a top wall of an outlet of a basin cavity 41 of the toilet determines a lower limit of the water seal surface in the toilet. As shown in FIG. 9, a distance between the lowest point of the top wall of the outlet of the basin cavity 41 and a central axis of the sewage inlet port 113 of the sewage discharge pipe 1 is denoted as H2, then a height H0 of the water seal surface in the toilet at the initial position is equal to L3–H2. Therefore, H0 is positively correlated with L3, but if H0 is too large, it will easily cause water splashing when using the toilet, and if H0 is too small, it will easily lead to poor water sealing effect and results in return of odor. On the other hand, by increasing a radius R of the sewage inlet port 113 so that R is greater than H2, it is advantageous to increase an area of the sewage inlet port 113, thereby improving the sewage discharge performance. However, the radius R of the sewage inlet port 113 must be less than L3, so L3 also affects R.

After research, by limiting a minimum distance L3 between the overflow port 115 and the central axis of the sewage inlet port 113 to a range from 70 mm to 116 mm, such as 70 mm, 80 mm, 90 mm, 100 mm, 110 mm, 116 mm, the area of the sewage inlet port 113 and the height H0 of the water seal of the toilet could meet the requirements.

Alternatively, the minimum distance between the overflow port 115 and the central axis of the sewage inlet port 113 is not limited to the above range and may be adjusted as necessary.

In an exemplary embodiment, the central axis of the sewage inlet port 113 vertically intersects with a central axis of the sewage discharge port 114, as shown in FIGS. 9, 11, and 13.

Thus, at the initial position, the pipe main body 11 of the sewage discharge pipe 1 may be in an upright state, and the sewage inlet port 113 may towards the front straightly, as shown in FIGS. 9, 11, and 13, and the sewage discharge pipe 1 may rotate about a horizontal axis of rotation. In contrast to the rotation of the sewage discharge pipe 1 about an inclined rotation axis, the present solution is advantageous in reducing a diverting range of sewage from the sewage inlet port 113 to the sewage discharge port 114, and is therefore advantageous in improving the sewage discharge performance of the sewage discharge pipe 1.

Moreover, this arrangement enables the sewage discharge box 2 to further be in an upright state, which is beneficial to reducing the difficulty of installing the sewage discharge box 2, and is beneficial to improving the stability and reliability of the sewage discharge box 2.

Figure 5:
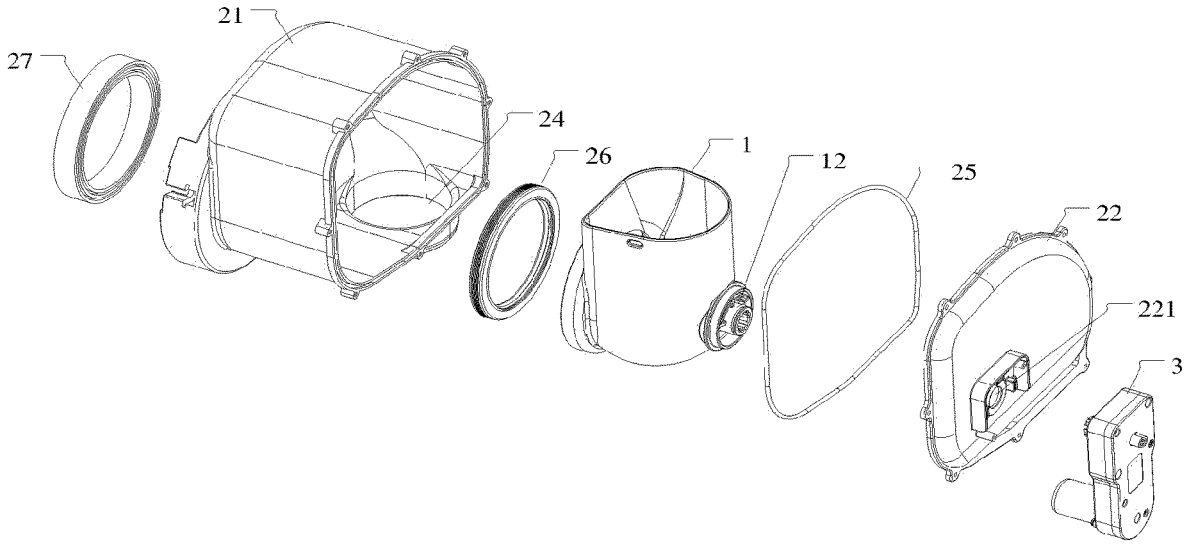
FIG. 5 is a schematic exploded view of a structure of a sewage discharge system according to one embodiment of the present disclosure.

As shown in FIG. 5, an embodiment of the present disclosure also provides a sewage discharge system, including a sewage discharge box 2, the sewage discharge pipe 1 as described in any one of the above embodiments, and a drive apparatus 3.

The sewage discharge pipe 1 is at least partially located in the sewage discharge box 2, and the sewage discharge pipe 1 is rotatably connected to the sewage discharge box 2.

The drive apparatus 3 is connected to the sewage discharge pipe 1 and is used for driving the sewage discharge pipe 1 to rotate relative to the sewage discharge box 2.

Since the sewage discharge system provided by an embodiment of the present disclosure includes the sewage discharge pipe 1 of any one of the aforementioned embodiments, it has all the beneficial effects of any of the aforementioned embodiments, which will not be described herein in detail.

The sewage discharge pipe 1 may be completely located in the sewage discharge box 2.

Optionally, the sewage discharge pipe 1 may only be partially located in the sewage discharge box 2. An inlet pipe section of the sewage discharge pipe 1 may protrude out of the sewage discharge box 2, and is rotatably connected to the toilet seat body 4, and is in communication with a sewage outlet 411 of the basin cavity 41 of the toilet.

In an exemplary embodiment, the sewage discharge box 2 includes a box main body 21 and a box cover 22, as shown in FIG. 5. The front part of the box main body 21 is provided with a dirt inlet 211, as shown in FIG. 13. The dirt inlet 211 communicates with the sewage outlet 411 of the basin cavity 41 of the toilet seat body 4. The sewage discharge pipe 1 is located in the sewage discharge box 2, and the sewage inlet port 113 of the sewage discharge pipe 1 is in communication with the dirt inlet 211 of the sewage discharge box 2. The lower part of the box main body 21 is provided with a dirt outlet 24, as shown in FIG. 5. The box cover 22 is connected with the box main body 21 in a covering manner. A sealing ring 25 is provided between the box cover 22 and the box main body 21, as shown in FIG. 5, and a first sealing element 26 is provided between the sewage discharge pipe 1 and the sewage discharge box 2. The box cover 22 is provided with a connection hole 221, as shown in FIG. 5, and the sewage discharge pipe 1 is provided with a rotation connection part 12. The drive apparatus 3 is connected to the rotation connection part 12 through the connection hole 221, and is used for driving the sewage discharge pipe 1 to rotate. The drive apparatus 3 may be a gearbox.

A sewage discharge principle of the sewage discharge system is as follows (as shown in FIGS. 9 to 14).

In the standby state, the sewage discharge pipe 1 is at the initial position, as shown in FIGS. 9 and 10. A brush ring flushing apparatus 42 discharges water, so that a height of the water seal surface of the toilet is raised to be flush with the sewage discharge port 114, as shown in FIGS. 11 and 12.

When rotating to discharge sewage, sewage in the basin cavity 41 of the toilet seat body 4 enters the sewage discharge pipe 1, and the sewage discharge pipe 1 is driven by the drive apparatus 3 to rotate to the right by 100° to 135° from the initial position (i.e., the sewage discharge port 114 faces directly above, as shown in FIGS. 11 and 12) to reach the sewage discharge position (as shown in FIGS. 13 and 14), and sewage is discharged from the sewage discharge port 114 through the dirt outlet 24 of the sewage discharge box 2.

After an action of sewage discharge is completed, the sewage discharged through the sewage discharge pipe 1 flows into a shifter 5 through the dirt outlet 24 of the sewage discharge box 2 and then is introduced into the external sewage discharge channel. A sealing ring is provided between the shifter 5 and the sewage discharge box 2. The sewage discharge pipe 1 is reset to the initial position (as shown in FIGS. 9 and 10) under the drive of the drive apparatus 3, and will be applied again for the next sewage discharge function.

Figure 6:
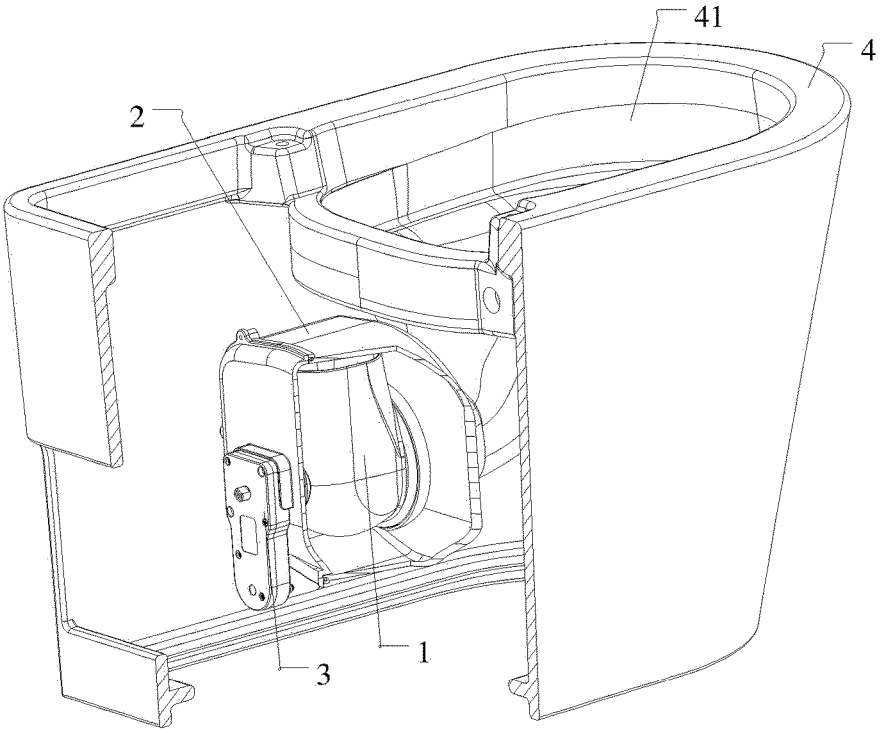
FIG. 6 is a schematic partial sectional diagram of a structure of a toilet according to one embodiment of the present disclosure.
Figure 7:
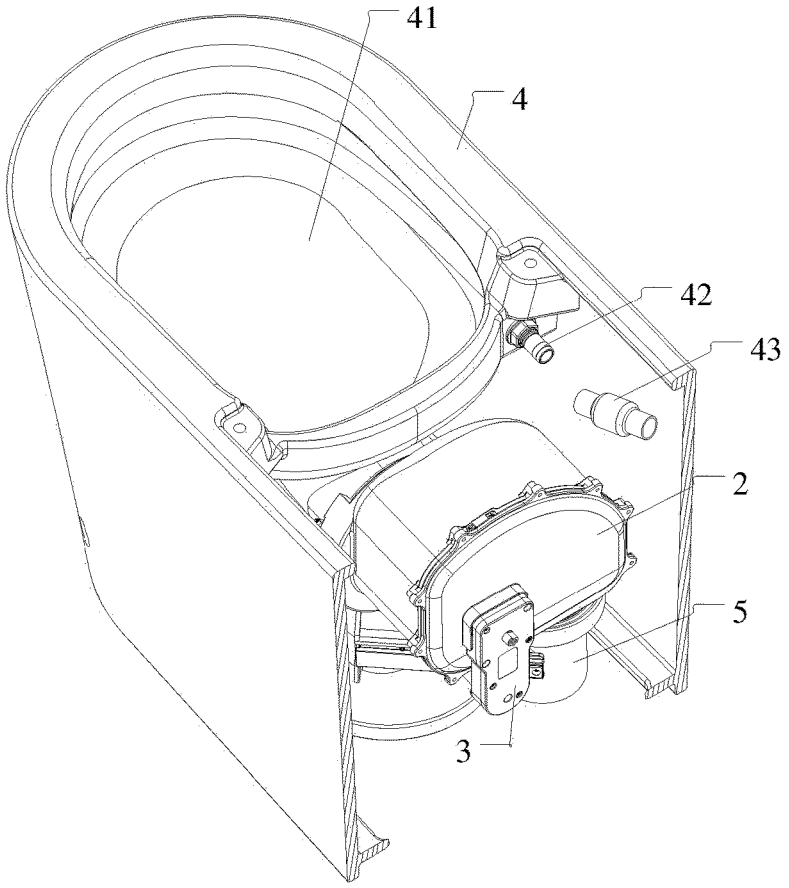
FIG. 7 is a schematic partial sectional diagram of a structure of a toilet according to another embodiment of the present disclosure.
Figure 8:
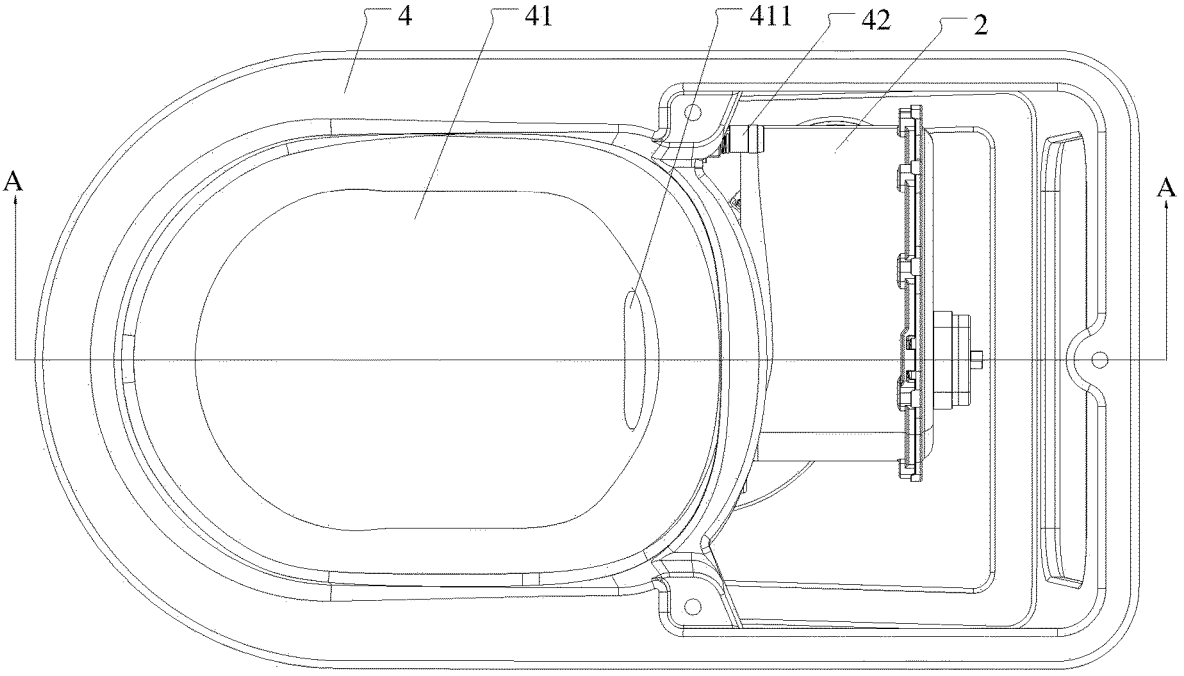
FIG. 8 is atop schematic partial view of a structure of a toilet according to one embodiment of the present disclosure.

As shown in FIGS. 6, 7 and 8, an embodiment of the present disclosure also provides a toilet, including a toilet seat body 4 and the sewage discharge system as described in above embodiments.

The toilet seat body 4 is provided with a basin cavity 41, and the basin cavity 41 is provided with a sewage outlet 411.

The sewage discharge system is installed in the toilet seat body 4, and the sewage inlet port 113 of the sewage discharge system is in communication with the sewage outlet 411.

The toilet provided by an embodiment of the present disclosure includes the sewage discharge system of the aforementioned embodiments, therefore it has all the aforementioned beneficial effects, which will not be described herein in detail.

The sewage discharge box 2 is fixedly connected to the toilet seat body 4, and a second sealing element 27 is provided between the sewage discharge box 2 and the toilet seat body 4.

In an exemplary embodiment, the sewage discharge box 2 is arranged in a vertical direction, as shown in FIGS. 9, 11, and 13.

Compared with a solution of an inclined arrangement of the sewage discharge box 2, the present solution is beneficial to reducing the installation difficulty of the sewage discharge box 2, and is also beneficial to reducing a volume of the toilet.

In an exemplary embodiment, the toilet seat body 4 is provided with a brush ring flushing apparatus 42. As shown in FIG. 7, the toilet also includes a flow detection apparatus 43 configured to detect a water flow rate of the brush ring flushing apparatus 42.

In this way, an amount of water output of the brush ring flushing apparatus 42 can be detected by the flow detection apparatus 43, which is beneficial to controlling the amount of water output according to needs, and thus is beneficial to saving water resources.

The toilet provided by an embodiment of the present disclosure includes the sewage discharge system of the aforementioned embodiments, therefore it has all the aforementioned beneficial effects, which will not be described herein in detail.

An embodiment of the present disclosure also provides a sewage discharge control method, which is applied to the aforementioned toilet.

The toilet includes a toilet seat body 4, a brush ring flushing apparatus 42, and a sewage discharge pipe 1. The sewage discharge pipe 1 is provided with a sewage inlet port 113, a sewage discharge port 114, and an overflow port 115. The sewage inlet port 113 communicates with the sewage outlet 411 of the toilet seat body 4. The sewage discharge pipe 1 is configured to be rotatable between the initial position and the sewage discharge position relative to the toilet seat body 4. When the sewage discharge pipe 1 is at the initial position, the overflow port 115 is located on a lower side of the sewage discharge port 114 and on an upper side of the sewage inlet port 113, and the water seal surface of the toilet is flush with a lowest point of the overflow port 115, as shown in FIGS. 9 and 10.

The sewage discharge box 2, the sewage discharge pipe 1, and the drive apparatus 3 constitute a rear-mounted sewage discharge system of the toilet. The sewage discharge box 2 is fixedly connected to the sewage outlet 411 of the toilet seat body 4, and the sewage discharge pipe 1 is located in the sewage discharge box 2. The drive apparatus 3 is connected to the sewage discharge pipe 1 and is used for driving the sewage discharge pipe 1 to rotate.

The rear-mounted sewage discharge system is used to replace the traditional siphon pipe sewage discharge/flushing mode, and adopts a falling discharge structure mode and utilizes a natural gravity falling mode to discharge sewage in the toilet from the basin cavity 41 and the pipe of the toilet. During a sewage discharge process, the sewage discharge pipe 1 rotates about the rotation axis to dump and discharge sewage. Under an action of gravity and falling discharge inertia, sewage in the basin cavity 41 of the toilet is efficiently and quickly discharged through the sewage discharge pipe 1.

The sewage discharge pipe 1 is arranged to rotate and switch between the initial position and the sewage discharge position. In a state where the sewage discharge pipe 1 is at the initial position, as shown in FIGS. 9 and 10, since the overflow port 115 is located on the upper side of the sewage inlet port 113 and on the lower side of the sewage discharge port 114, it is ensured that a water seal can be formed in the toilet. Since the overflow port 115 is located on the lower side of the sewage discharge port 114 at this time, the liquid in the sewage discharge pipe 1 above the overflow port 115 flows out through the overflow port 115 until a water seal surface is flush with a lowest point of the overflow port 115, and a height of water seal at this time is only H0, as shown in FIG. 9. Therefore, the overflow port 115 can reduce a height of a position of the water seal surface and prevent water splashing when the user uses the toilet, which is beneficial to improving the user experience.

When it is necessary to discharge sewage, the brush ring flushing apparatus 42 injects water into the inside of the toilet seat body 4. Since a flow rate of water inflow is much greater than a flow rate of overflow of the overflow port 115, the water seal surface in the toilet can be rapidly raised to a position where the sewage discharge port 114 is located, as shown in FIGS. 11 and 12, and a height of water seal is increased by Hs to reach H1, thereby increasing a volume of flushing water and gravitational potential energy of the flushing water. Then the sewage discharge pipe 1 is controlled to rotate downwards to the sewage discharge position (as shown in FIGS. 13 and 14), and a relatively large water volume and gravitational potential energy can be used to achieve a better sewage discharge and flushing effect.

Therefore, during the sewage discharge process, a difference between a height of the initial water seal surface and a height of the water seal surface at a time of discharge and falling can be controlled to increase the sewage discharge efficiency and improve the sewage discharge effect.

Figure 15:
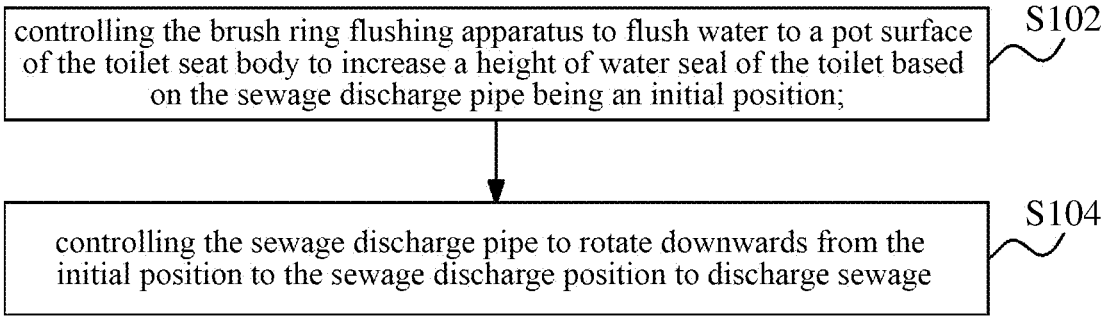
FIG. 15 is a schematic flow diagram of a sewage discharge control method according to one embodiment of the present disclosure.

As shown in FIG. 15, the sewage discharge control method includes:

Step S102: controlling the brush ring flushing apparatus to flush water to a pot surface of the toilet seat body to increase a height of water seal of the toilet based on the sewage discharge pipe being at an initial position; and Step S104: controlling the sewage discharge pipe to rotate downwards from the initial position to the sewage discharge position to discharge sewage.

According to the sewage discharge control method provided by an embodiment of the present disclosure, it is only necessary to control the rotation of the sewage discharge pipe 1 between the initial position and the sewage discharge position. Compared with a solution that changes a height of the water seal by controlling a position change of the sewage discharge pipe 1 (i.e., in a standby state, the sewage discharge pipe 1 is at an inclined position to lower the water seal surface, and when it is necessary to discharge sewage, first the sewage discharge pipe 1 is controlled to rotate to an upright position to raise the water seal surface, and then the sewage discharge pipe 1 is controlled to rotate downwards to discharge sewage), the present solution can achieve an effect of changing a height of water seal by the overflow port 115. A position of the sewage discharge pipe 1 only needs to be changed between the initial position and the sewage discharge position, and switching to the inclined position in the standby state is eliminated. Therefore, an electronic control program of the sewage discharge pipe 1 can be simplified, a failure rate of the electronic control can be reduced, and it is also beneficial to reduce rotation error accumulated during long-term use of the sewage discharge pipe 1, therefore it is beneficial to improve control accuracy.

Figure 16:
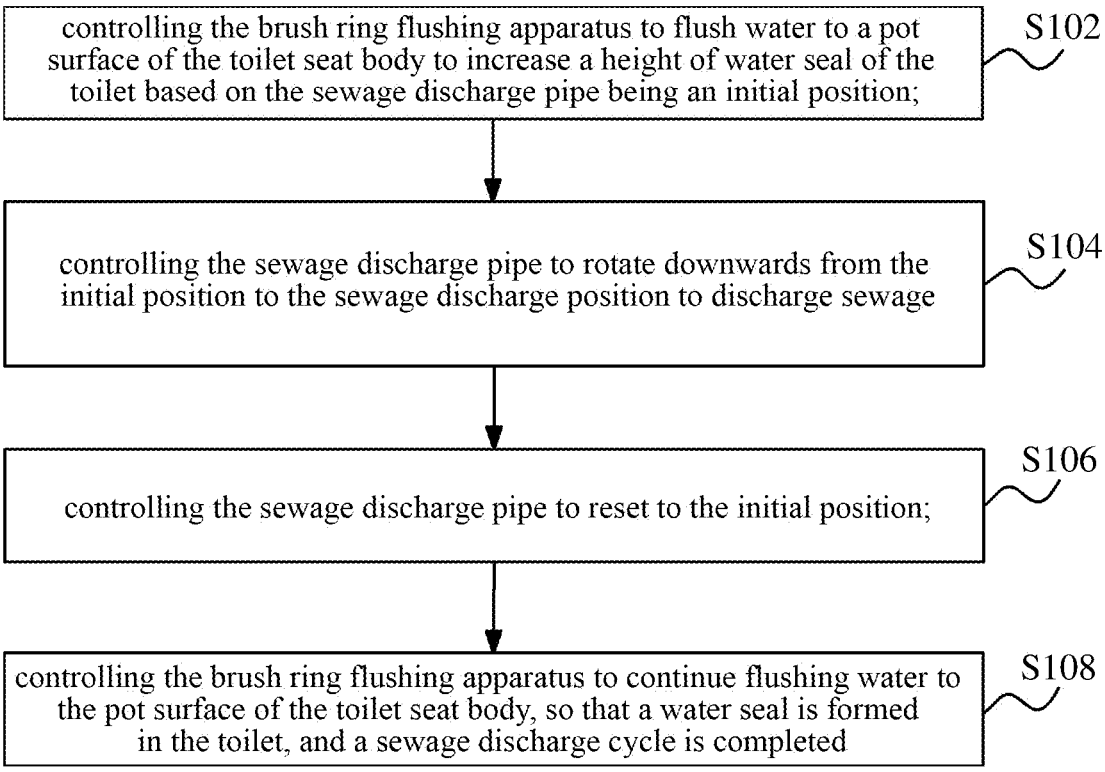
FIG. 16 is a schematic flow diagram of a sewage discharge control method according to one embodiment of the present disclosure.

In an exemplary embodiment, as shown in FIG. 16, after step S104, the sewage discharge control method may further include:

Step S106: controlling the sewage discharge pipe to reset to the initial position; and Step S108: controlling the brush ring flushing apparatus to continue flushing water to the pot surface of the toilet seat body so that a water seal is formed in the toilet, and a sewage discharge cycle is completed.

In this way, after sewage is discharged, the sewage discharge pipe 1 is automatically reset to the initial position. Further, the brush ring flushing apparatus 42 continues to flush water to the pot surface of the toilet seat body 4, so that the water seal can be formed in the toilet for the next use.

It can be understood that the pot surface of the toilet seat body refers to an inner wall surface of the basin cavity 41 of the toilet seat body 4, and may also be called as an inner washing surface of the toilet.

In an exemplary embodiment, controlling the brush ring flushing apparatus 42 to continue flushing water to the pot surface of the toilet seat body 4 so that the water seal is formed in the toilet includes: controlling the brush ring flushing apparatus 42 to continue flushing water to the pot surface of the toilet seat body 4 until a water surface in the toilet is higher than a lowest point of the overflow port 115 and then the brush ring flushing apparatus 42 is closed, so that a water surface in the toilet is lowered to be flush with the lowest point of the overflow port 115 through overflow, forming the water seal.

In the water replenishment stage after the action of sewage discharge is completed, when a water surface in the toilet is higher than the lowest point of the overflow port 115, the brush ring flushing apparatus 42 is closed, which can ensure that a water seal finally formed in the toilet is flush with the lowest point of the overflow port 115 and does not fall below the overflow port 115. This can prevent a height of water seal surface in the toilet from being too low and causing odor to overflow.

In an exemplary embodiment, controlling the brush ring flushing apparatus 42 to continue flushing water to the pot surface of the toilet seat body 4 until the water surface in the toilet is higher than the lowest point of the overflow port 115 and then the brush ring flushing apparatus 42 is closed includes: when the sewage discharge pipe 1 is reset to the initial position, starting a water replenishment timing until a water replenishment duration reaches a set duration, and then the brush ring flushing apparatus 42 is closed.

Since shapes of the toilet seat body 4 and the sewage discharge pipe 1 are fixed, an amount of water required to form a water seal is also fixed. During the design process, a minimum duration for water replenishment required to reset the sewage discharge pipe 1 to form a water seal can be determined by timing. If the water replenishment duration during use is greater than the minimum duration for water replenishment during a test process, then the water seal surface of the toilet can be guaranteed to be higher than the lowest point of the overflow port 115. Therefore, the set duration can be set to be greater than the minimum duration for water replenishment during the test process.

The closing of the brush ring flushing apparatus 42 is controlled by time, which is beneficial to simplifying the electronic control program and further reducing the failure rate of the electronic control.

In another exemplary embodiment, controlling the brush ring flushing apparatus 42 to continue flushing water to the pot surface of the toilet seat body 4 until the water surface in the toilet is higher than the lowest point of the overflow port 115 and then the brush ring flushing apparatus 42 is closed includes: when the sewage discharge pipe 1 is reset to the initial position, detecting an amount of water output of the brush ring flushing apparatus 42 until the amount of water output of the brush ring flushing apparatus 42 reaches a set amount of water output and then the brush ring flushing apparatus 42 is closed.

Since shapes of the toilet seat body 4 and the sewage discharge pipe 1 are fixed, an amount of water required to form the water seal is also fixed. During the design process, a minimum amount of water output flow required to reset the sewage discharge pipe 1 to form a water seal can be determined by detecting an amount of flow. If an amount of output replenishment water during use is greater than the minimum amount of water output flow during a test process, then the water seal surface of the toilet can be guaranteed to be higher than the lowest point of the overflow port 115. Therefore, the set amount of water output can be set to be greater than the minimum amount of water output flow during the test process.

Compared with controlling the closing of the brush ring flushing apparatus 42 by duration, the present solution controls the closing of the brush ring flushing apparatus 42 by the amount of flow, which has higher reliability and is beneficial to saving water.

In an exemplary embodiment, during a sewage discharge cycle, the brush ring flushing apparatus 42 continues to discharge water after turning on until being closed.

The brush ring flushing apparatus 42 of a conventional toilet generally only discharges water in an initial stage, and its main function is to wet an inner wall surface (i.e., the pot surface of the toilet seat body) of the basin cavity 41 of the toilet, so as to cause sewage hanging on the inner wall surface of the basin cavity 41 to fall. After that, the brush ring flushing apparatus is closed, and an injection apparatus opposite to the sewage outlet 411 of the toilet seat body 4 is turned on, and sewage is flushed out by a high-speed and large-flow water flow of the injection apparatus.

In an embodiment of the present disclosure, the brush ring flushing apparatus 42 is continuously turned on in an initial stage, a sewage discharge stage, and a water replenishment stage. In the initial stage, the brush ring flushing apparatus 42 plays a role of wetting and improving the water seal surface, in the sewage discharge stage, the brush ring flushing apparatus 42 plays a role of increasing a gravitational potential energy of the sewage, and in the water replenishment stage, the brush ring flushing apparatus 42 plays a role of providing water for water seal. Therefore, the brush ring flushing apparatus 42 continuously fill water, which is beneficial to improving the sewage discharge performance, and is also beneficial to simplifying the electronic control program of the toilet.

In an exemplary embodiment, during a sewage discharge cycle:

before the sewage discharge pipe 1 starts to rotate (i.e., the initial stage), a turned-on duration of the brush ring flushing apparatus 42 is in the range from 5 s to 6 s, such as 5 s, 5.2 s, 5.4 s, 5.5 s, 5.6 s, 5.8 s, 6 s;

a duration between the start of rotation of the sewage discharge pipe 1 and the start of reset rotation of the sewage discharge pipe 1 (i.e., the sewage discharge stage) is in the range from 3 s to 8 s, such as 3 s, 4 s, 5 s, 6 s, 7 s, 8 s; and a duration between the start of the reset rotation of the sewage discharge pipe 1 and the closing of the brush ring flushing apparatus 42 (i.e., the water replenishment stage) is in the range from 4 s to 10 s, such as 4 s, 5 s, 6 s, 7 s, 8 s, 9 s, 10 s.

It has been verified that in a sewage discharge and flushing flow process, by limiting a water flushing duration of each stage of the brush ring flushing apparatus 42 to the aforementioned range, it is possible to use as little water resource as possible on the basis of ensuring effective flushing of the inner wall surface of the basin cavity 41 and the sewage discharge pipe 1. This can not only avoid a poor sewage discharge and flushing effect caused by too short water flushing duration, but also avoid excessive water consumption and increased water resource waste caused by too long water flushing duration.

Alternatively, the duration of each of the aforementioned stages is not limited to the aforementioned range and can be adjusted as needed.

In an exemplary embodiment, a rotation angle of the sewage discharge pipe 1 from the initial position to the sewage discharge position is in the range from 100° to 135°.

Compared with the rotation of the sewage discharge pipe 1 by 180° from the top to the bottom, the rotation angle B of the sewage discharge pipe 1 is limited to the aforementioned range. This can not only meet a demand for rotational sewage discharge, but also reduce a motion range of the sewage discharge pipe 1, thereby facilitating a reduction of a volume of the sewage discharge box 2, facilitating a miniaturization of the sewage discharge box 2, and facilitating an improvement of the flexibility and adaptability of the sewage discharge system 10.

In addition, because the time node in the early stage of the sewage discharge process has the greatest impact on the sewage discharge effect, if the rotation range are too great and the rotation time are too long, then it is not beneficial to the stability of the sewage discharge effect and the consistency of the effect. Therefore, limiting the rotation angle B of the sewage discharge pipe 1 within the aforementioned range also facilitates shortening the motion time of the sewage discharge pipe 1, thereby making the overall sewage discharge effect more stable.

Alternatively, the rotation angle B of the sewage discharge pipe 1 is not limited to the aforementioned range from the initial sewage discharge position to the sewage discharge position, and can be adjusted as necessary.

In an exemplary embodiment, when the sewage discharge pipe 1 is at the initial position, the sewage discharge port 114 faces horizontally upwards, as shown in FIGS. 9, 10, 11, and 12.

In this way, when the sewage discharge pipe 1 is at the initial position and the brush ring flushing apparatus 42 is turned on, the water seal surface of the toilet can be raised to be flush with the sewage discharge port 114, so that an internal space of the sewage discharge pipe 1 can be fully utilized, and a gravitational potential energy of the liquid and sewage in the pipe can be raised as much as possible, thereby improving the sewage discharge efficiency and sewage discharge effect.

In an exemplary embodiment, the sewage discharge control method may further include: after power on, controlling the sewage discharge pipe 1 to rotate from a position before power on to an initial position; and controlling the brush ring flushing apparatus 42 to flush water to the pot surface of the toilet seat body 4, so that a water seal is formed in a toilet and the toilet enters a standby state.

Since the position of the sewage discharge pipe 1 may change due to external forces or other factors in a power-off state, after power on, the sewage discharge pipe 1 is first controlled to rotate to the initial position, and then the brush ring flushing apparatus 42 is turned on to inject water, which is beneficial to ensuring an accuracy of the subsequent position of a water seal surface.

In an exemplary embodiment, the sewage discharge control method may further include a step: confirming that the toilet enters a state of use or a state to be flushed, and performing a step of controlling the brush ring flushing apparatus 42 to flush water to the pot surface of the toilet seat body 4 to increase a height of water seal of the toilet.

When it is confirmed that the toilet enters a state of use or a state to be flushed, the toilet will automatically enter the sewage discharge and flushing flow process without manual operation by the user, thereby improving the automation program of the product and it is beneficial to improving the user experience.

The toilet can enter the sewage discharge and flushing flow process when the toilet enters a state of use, so that an inner wall surface of basin cavity 41 of the toilet can be wetted, and an occurrence of sewage hanging on the wall can be reduced.

The toilet can also enter the sewage discharge and flushing flow process when the toilet enters a state to be flushed, which is beneficial to saving water resources.

In an exemplary embodiment, in a step of confirming that the toilet enters a state of use or a state to be flushed, it is confirmed that the toilet enters a state of use by detecting a user on-seat signal, and it is confirmed that the toilet enters a state to be flushed by detecting a user off-seat signal.

A detection apparatus can be provided on the toilet seat ring, and when a user sits on the toilet seat ring, a state of the detection apparatus will change, thereby confirming that the toilet enters the state of use. When a user leaves the toilet seat ring after use, a state of the detection apparatus will also change, thereby confirming that the toilet enters the state to be flushed.

In an example, the on-seat signal and the off-seat signal include a gravity signal. In this case, the detection apparatus may include a gravity sensor to confirm the state of the toilet by detecting changes in a magnitude of gravity generated when a user sits or leaves the seat.

In another example, the on-seat signal and the off-seat signal include an infrared signal. In this case, the detection apparatus may include an infrared sensor to confirm the state of the toilet by detecting changes in infrared signals generated when a user sits or leaves the seat.

In an exemplary embodiment, the control method may further include receiving an externally inputted flushing command; and after receiving the externally inputted flushing command, performing a step of controlling the brush ring flushing apparatus 42 to flush water to the pot surface of the toilet seat body 4 to increase a height of water seal of the toilet.

In other words, a user sends a flushing command through an operation (such as pressing the remote control or the flushing button on the toilet), and after receiving the command from the user, the sewage discharge and flushing flow process just begins. This solution ensures that the toilet can execute the sewage discharge and flushing flow process according to the manual control of a user, which can meet immediate needs of the user.

Figure 17:
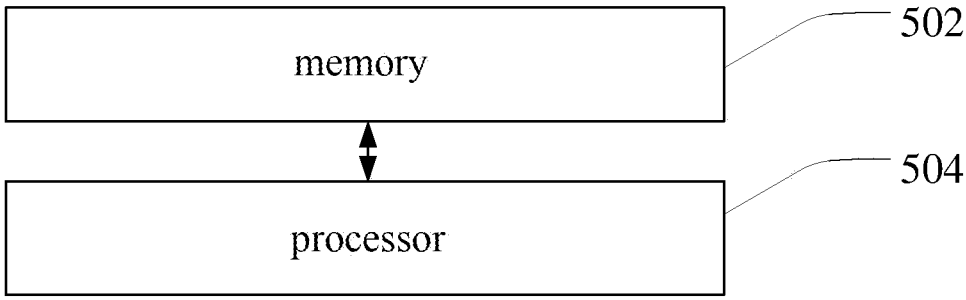
FIG. 17 is a schematic block diagram of a sewage discharge control apparatus according to one embodiment of the present disclosure.

As shown in FIG. 17, an embodiment of the present disclosure further provides a sewage discharge control apparatus, including a processor 504 and a memory 502 storing a computer program. When the processor 504 executes the computer program, it implements steps of the sewage discharge control method as in any of the above embodiments.

The processor may be an integrated circuit chip with an ability of processing signals. The aforementioned processor may be a general-purpose processor, including a central processing unit (CPU), a network processor (NP), and the like. The processor may also be a digital signal processor (DSP), an application specific integrated circuit (ASIC), an off-the-shelf programmable gate array (FPGA) or other programmable logic device, a discrete gate or transistor logic device, and a discrete hardware component. The methods, steps, and logical block diagrams disclosed in embodiments of the present disclosure may be implemented or executed. The general-purpose processor may be a microprocessor or the processor may be any conventional processor or the like.

An embodiment of the present disclosure further provides a toilet, which includes the aforementioned sewage discharge control apparatus, and thus has all the aforementioned beneficial effects, which will not be described herein in detail.

In any one or more of the exemplary embodiments described above, the functions described may be implemented in hardware, software, firmware, or any combination thereof. If implemented in software, the functions may be stored on or transmitted via a computer readable medium as one or more instructions or codes and executed by a hardware-based processing unit. The computer readable medium may include a computer readable storage medium corresponding to a tangible medium such as a data storage medium, or a communication medium including any medium facilitating a transfer of a computer program from one place to another, for example, according to a communication protocol. In this manner, the computer readable medium may generally correspond to a non-transient tangible computer readable storage medium or a communication medium such as signal or carrier wave. The data storage medium may be any available medium accessible by one or more computers or one or more processors to retrieve instructions, code, and/or data structures for implementing the techniques described in the present disclosure. The computer program product may include a computer readable medium.

By way of example and without limitation, such computer readable storage media may include RAM, ROM, EEPROM, CD-ROM or other optical disc storage apparatus, disk storage apparatus or other magnetic storage apparatus, flash memory or any other media that may be used to store desired program code in a form of instructions or data structures and accessible by a computer. Further, any connection may also be referred to as a computer readable medium. For example, if coaxial cables, fiber optic cables, twisted pair cables, digital subscriber lines (DSL), or wireless technologies such as infrared, radio, and microwave are used to transmit instructions from a website, server, or other remote source, the coaxial cables, fiber optic cables, twisted pair cables, DSL, or wireless technologies such as infrared, radio, and microwave are included in the definition of a medium. However, it should be appreciated that the computer readable storage medium and the data storage medium do not include connections, carriers, signals or other instantaneous (transient) media, but are intended for non-instantaneous tangible storage media. As used herein, disks and optical discs include compact discs (CDs), laser discs, optical discs, digital versatile discs (DVDs), floppy disks or Blu-ray discs, and the like. The disks generally reproduce data magnetically and the optical discs reproduce data optically using lasers. The above combinations should also be included in a range of computer readable media.

For example, instructions may be executed by one or more processors, such as one or more digital signal processors (DSPs), general purpose microprocessors, application specific integrated circuits (ASICs), field programmable logic arrays (FPGAs), or other equivalent integrated or discrete logic circuits. Accordingly, the term "processor" as used herein may refer to any of the aforementioned architectures or any other architectures suitable for implementing the techniques described herein. Further in some aspects, the functionality described herein may be provided within dedicated hardware and/or software modules configured for encoding and decoding or incorporated in a modular codec. Further, the techniques may be fully implemented in one or more circuits or logic elements.

The technique solution of an embodiment of the present disclosure may be implemented in a wide variety of devices or apparatuses, including wireless handsets, integrated circuits (ICs), or a set of ICs (e.g., chipsets). Various components, modules, or units are depicted in an embodiment of the present disclosure to emphasize functional aspects of an apparatus configured to perform the described techniques but do not necessarily need to be implemented by different hardware units. Rather, as described above, the various units may be combined in codec hardware units or provided by a set of interoperable hardware units (including one or more processors as described above) in combination with appropriate software and/or firmware.

In the description of an embodiment of the present disclosure, it should be noted that the orientation or position relationships indicated by the terms "upper", "lower", "one side", "the other side", "one end", "the other end", "side", "relative", "four corners", "periphery" and "structure" or the like are based on the orientation or position relationships shown in the drawings, which are only for convenience of describing an embodiment of the present disclosure and simplifying the description, rather than indicating or implying that the structure referred has the specific orientation, or is constructed and operated in the specific orientation, and thus cannot be interpreted as a limitation on the present disclosure.

In the description of an embodiment of the present disclosure, unless otherwise expressly specified and limited, the terms "connection", "direct connection", "indirect connection", "fixed connection", "mounting" and "assembly" should be understood in a broad sense. For example, they may be fixed connections, detachable connections or integrated connections; and the terms "mounting", "connection" and "fixed connection" may be direct connections, or indirect connections through an intermediary, or may be an internal communication between two elements. For those of ordinary skills in the art, the meanings of the above terms in an embodiment of the present disclosure can be understood according to situations.

Although implementations disclosed in the present disclosure are described above, the described contents are only implementations adopted for facilitating understanding of the present disclosure, and are not intended to limit the present disclosure. Without departing from the spirit and scope disclosed by the present disclosure, any person skilled in the art to which the present disclosure belongs may make any modifications and changes in the form and details of implementation, but the scope of patent protection of the present disclosure shall still be defined by the appended claims.

The invention claimed is:

1. A sewage discharge pipe, comprising:

a pipe main body, wherein the pipe main body is provided with a sewage inlet port, a sewage discharge port, and an overflow port, the sewage discharge port is in a different direction from the sewage inlet port, the sewage inlet port is configured to be communicated with a sewage outlet of a toilet seat body, and the pipe main body is configured to be capable of rotating between an initial position and a sewage discharge position around a central axis of the sewage inlet port relative to the toilet seat body;

wherein in a state where the pipe main body is located at the initial position, an opening of the sewage discharge port faces upwards, and the overflow port is located on a lower side of the sewage discharge port and on an upper side of the sewage inlet port.

2. The sewage discharge pipe according to claim 1, wherein one end of the pipe main body forms the sewage discharge port, the other end of the pipe main body is provided as closed, and the sewage inlet port is provided in a side wall of the pipe main body; and wherein the pipe main body comprises:

a cylindrical part, one end of the cylindrical part forms the sewage discharge port, and the sewage inlet port is provided in a side wall of the cylindrical part and extends to the other end of the cylindrical part; and a bottom sealing part, the bottom sealing part is connected with the other end of the cylindrical part, and seals and covers the other end of the cylindrical part.

3. The sewage discharge pipe according to claim 2, wherein the bottom sealing part is recessed in a direction away from the sewage discharge port, so that a maximum distance between the bottom sealing part and the sewage discharge port is greater than a maximum distance between the sewage inlet port and the sewage discharge port.

4. The sewage discharge pipe according to claim 2, wherein the cylindrical part comprises a first plate part, a second plate part, a third plate part, and a fourth plate part connected sequentially end to end in a circumferential direction of the cylindrical part;

wherein the first plate part is a first straight plate and the sewage inlet port is provided in the first plate part; and wherein the first plate part, the second plate part, the third plate part, and the fourth plate part are smoothly connected.

5. The sewage discharge pipe according to claim 4, wherein the sewage discharge pipe rotates to a side where the fourth plate part is located during rotating from the initial position to the sewage discharge position;

the second plate part is a second straight plate; the third plate part is an arc-shaped plate, and the arc-shaped plate is bent in a direction away from the first plate part;

the fourth plate part comprises: a third straight plate connected to the third plate part, and a curved plate connected to the first plate part; in a direction close to the sewage discharge port, the curved plate is curved and recessed in a direction close to the second plate part and the third plate part.

6. The sewage discharge pipe according to claim 5, wherein the overflow port is provided in the second plate part; or in a direction from the first plate part to the third plate part, the second straight plate and the third straight plate extend obliquely in directions approaching each other.

7. The sewage discharge pipe according to claim 2, wherein a diameter of the sewage inlet port is greater than a half of a length of the cylindrical part.

8. The sewage discharge pipe according to claim 1, wherein in a state where the sewage discharge pipe is at the initial position, a height of the overflow port is in a range from 2 mm to 10 mm, and a width of the overflow port is in a range from 5 mm to 30 mm; or a minimum distance between the overflow port and the central axis of the sewage inlet port is in a range from 70 mm to 116 mm; or the central axis of the sewage inlet port vertically intersects with a central axis of the sewage discharge port.

9. The sewage discharge pipe according to claim 1, further comprising:

a rotation connection part connected to the pipe main body and configured to connect a drive apparatus for driving the pipe main body to rotate around the central axis of the sewage inlet port; or a connection boss, wherein the connection boss is located outside the sewage inlet port and is connected to an outer wall of the pipe main body, and an inner diameter of the connection boss is greater than a diameter of the sewage inlet port.

10. A sewerage discharge system, comprising:

a sewage discharge box;

the sewage discharge pipe according to claim 1 at least partially located in the sewage discharge box and rotatably connected to the sewage discharge box; and a drive apparatus, wherein the drive apparatus is connected to the sewage discharge pipe, and is configured to drive the sewage discharge pipe to rotate relative to the sewage discharge box.

11. A toilet, comprising:

a toilet seat body, wherein the toilet seat body is provided with a basin cavity, and the basin cavity is provided with a sewage outlet; and the sewage discharge system according to claim 10, wherein the sewage discharge system is installed on the toilet seat body, and the sewage inlet port of the sewage discharge system is in communication with the sewage outlet.

12. The toilet according to claim 11, wherein the sewage discharge box is arranged in a vertical direction; and the toilet seat body is provided with a brush ring flushing apparatus, the toilet further comprising:

a flow detection apparatus, wherein the flow detection apparatus is configured to detect a water flow rate of the brush ring flushing apparatus.

13. A sewage discharge control method, applied to a toilet, wherein the toilet comprises a toilet seat body, a brush ring flushing apparatus, and a sewage discharge pipe; the sewage discharge pipe is provided with a sewage inlet port, a sewage discharge port, and an overflow port; the sewage inlet port communicates with a sewage outlet of the toilet seat body, and the sewage discharge pipe is configured to be rotatable between an initial position and a sewage discharge position relative to the toilet seat body; when the sewage discharge pipe is at the initial position, the overflow port is located on a lower side of the sewage discharge port and on an upper side of the sewage inlet port, and a water seal surface of the toilet is flush with a lowest point of the overflow port;

the sewage discharge control method comprises:

controlling the brush ring flushing apparatus to flush water to a pot surface of the toilet seat body to increase a height of water seal of the toilet based on the sewage discharge pipe being at the initial position; and controlling the sewage discharge pipe to rotate downwards from the initial position to the sewage discharge position to discharge sewage.

14. The sewage discharge control method according to claim 13, wherein after a process of controlling the sewage discharge pipe to rotate downwards from the initial position to the sewage discharge position to discharge sewage, the sewage discharge control method further comprises:

controlling the sewage discharge pipe to reset to the initial position; and controlling the brush ring flushing apparatus to continue flushing water to the pot surface of the toilet seat body so that a water seal is formed in the toilet and a sewage discharge cycle is completed; and wherein controlling the brush ring flushing apparatus to continue flushing water to the pot surface of the toilet seat body so that the water seal is formed in the toilet, comprising:

controlling the brush ring flushing apparatus to continue flushing water to the pot surface of the toilet seat body until a water surface in the toilet is higher than a lowest point of the overflow port and then the brush ring flushing apparatus is closed, so that a water surface in the toilet is lowered to be flush with the lowest point of the overflow port through overflow, forming the water seal.

15. The sewage discharge control method according to claim 14, wherein controlling the brush ring flushing apparatus to continue flushing water to the pot surface of the toilet seat body until a water surface in the toilet is higher than a lowest point of the overflow port and then the brush ring flushing apparatus is closed, comprising:

when the sewage discharge pipe is reset to the initial position, starting a water replenishment timing until a water replenishment duration reaches a set duration, and then the brush ring flushing apparatus is closed; or when the sewage discharge pipe is reset to the initial position, detecting an amount of water output of the brush ring flushing apparatus until the amount of water output of the brush ring flushing apparatus reaches a set amount of water output, and then the brush ring flushing apparatus is closed.

16. The sewage discharge control method according to claim 14, wherein during the sewage discharge cycle, the brush ring flushing apparatus continues to discharge water after turning on until being closed; or wherein during the sewage discharge cycle:

before the sewage discharge pipe starts to rotate, a turned-on duration of the brush ring flushing apparatus is in the range from 5 s to 6 s;

a duration between the start of rotation of the sewage discharge pipe and the start of reset rotation of the sewage discharge pipe is in the range from 3 s to 8 s;

a duration between the start of the reset rotation of the sewage discharge pipe and the closing of the brush ring flushing apparatus is in the range from 4 s to 10 s.

17. The sewage discharge control method according to claim 13, further comprising:

after power on, controlling the sewage discharge pipe to rotate from a position before power on to the initial position; and controlling the brush ring flushing apparatus to flush water to the pot surface of the toilet seat body, so that a water seal is formed in the toilet and the toilet enters a standby state; or confirming that the toilet enters a state of use or a state to be flushed, and performing a step of controlling the brush ring flushing apparatus to flush water to the pot surface of the toilet seat body to increase a height of a water seal of the toilet; and wherein in a step of confirming that the toilet enters a state of use or a state to be flushed, confirming that the toilet enters a state of use by detecting a user on-seat signal, and confirming that the toilet enters a state to be flushed by detecting a user off-seat signal.

18. The sewage discharge control method according to claim 13, further comprising: receiving an externally inputted flushing command; and after receiving the externally inputted flushing command, performing a step of controlling the brush ring flushing apparatus to flush water to the pot surface of the toilet seat body to increase a height of water seal of the toilet; or wherein a rotation angle of the sewage discharge pipe from the initial position to the sewage discharge position is in the range from 100° to 135°.

19. A sewage discharge control apparatus, comprising a processor and a memory storing a computer program, the processor implements the steps of the sewage discharge control method according to claim 13 when executing the computer program.

20. A toilet, comprising the sewage discharge control apparatus according to claim 19.

* * * * *